US009301357B2

(12) United States Patent
Choi et al.

(10) Patent No.: US 9,301,357 B2
(45) Date of Patent: Mar. 29, 2016

(54) BACKLIGHT UNIT CONTROLLING CURRENT TO LIGHT SOURCE UNIT AND DISPLAY APPARATUS HAVING THE SAME

(75) Inventors: Kyung-Uk Choi, Gunpo-si (KR); Byeong Doo Kang, Asan-si (KR); Chang Sin Kim, Suwon-si (KR); Jeong Bong Lee, Busan (KR)

(73) Assignee: SAMSUNG DISPLAY CO., LTD. (KR)

( * ) Notice: Subject to any disclaimer, the term of this patent is extended or adjusted under 35 U.S.C. 154(b) by 168 days.

(21) Appl. No.: 13/549,916

(22) Filed: Jul. 16, 2012

(65) Prior Publication Data

US 2013/0235090 A1 Sep. 12, 2013

(30) Foreign Application Priority Data

Mar. 7, 2012 (KR) ..... 10-2012-0023608

(51) Int. Cl.

*G09G 3/36* (2006.01)
*H05B 33/08* (2006.01)
*G09G 3/34* (2006.01)

(52) U.S. Cl.

CPC ..... *H05B 33/0827* (2013.01); *G09G 3/342* (2013.01); *G09G 2320/0633* (2013.01); *G09G 2330/021* (2013.01); *G09G 2330/06* (2013.01)

(58) Field of Classification Search

CPC ..... G09G 3/3406; G09G 2320/0626; G09G 2320/064; G09G 2320/0646
USPC ..... 345/102; 349/61–70; 362/561
See application file for complete search history.

(56) References Cited

U.S. PATENT DOCUMENTS

| | | | | |
|---|---|---|---|---|
| 7,171,461 | B2 | 1/2007 | Ewing et al. | |
| 7,394,854 | B2 | 7/2008 | Nishio et al. | |
| 7,683,553 | B2 * | 3/2010 | Fong | 315/185 R |
| 2006/0158392 | A1 * | 7/2006 | Liao et al. | 345/76 |
| 2008/0123720 | A1 | 5/2008 | Fujii | |
| 2009/0109168 | A1 * | 4/2009 | Lee et al. | 345/102 |
| 2009/0184664 | A1 | 7/2009 | Jeong et al. | |
| 2010/0291919 | A1 | 11/2010 | Whittam et al. | |

FOREIGN PATENT DOCUMENTS

| | | | |
|---|---|---|---|
| JP | 2008-216872 | A | 9/2008 |
| JP | 4584199 | B2 | 11/2010 |
| KR | 1020080011845 | A | 2/2008 |
| KR | 10-0869614 | B1 | 11/2008 |
| KR | 1020090059505 | A | 6/2009 |
| KR | 1020110026563 | A | 3/2011 |

* cited by examiner

*Primary Examiner* — Ram Mistry
(74) *Attorney, Agent, or Firm* — Cantor Colburn LLP

(57) ABSTRACT

A backlight unit includes light source units which emit light, and light source driving integrated circuits which control a brightness of the light source units, respectively. Each of the light source driving integrated circuits includes a current generator which generates a first current and a second current, a current level controller which controls a current value of the first current in response to duty ratio information of a pulse width modulation signal, a voltage supply unit which outputs a voltage corresponding to the second current, an output buffer unit which outputs the voltage from the voltage supply unit, and a driving switch unit which drives the light source units to allow a current corresponding to the voltage provided from the output buffer unit to flow through the light source units, where current values of the second current and the first current are the same as each other.

9 Claims, 6 Drawing Sheets

BACKLIGHT UNIT CONTROLLING CURRENT TO LIGHT SOURCE UNIT AND DISPLAY APPARATUS HAVING THE SAME

This application claims priority to Korean Patent Application No. 10-2012-0023608, filed on Mar. 7, 2012, and all the benefits accruing therefrom under 35 U.S.C. §119, the content of which in its entirety is herein incorporated by reference.

BACKGROUND

1. Field

Exemplary embodiments relate to a backlight unit and a display apparatus having the backlight unit. More particularly, exemplary embodiments relate to a backlight unit, in which an occurrence of an audible noise is effectively prevented and power consumption is substantially reduced, and a display apparatus having the backlight unit.

2. Description of the Related Art

In recent, various display apparatuses, such as a liquid crystal display, an organic light emitting diode display, an electro-wetting display and an electrophoretic display, for example, have been developed.

In general, the liquid crystal display includes a display panel with a liquid crystal layer, a driving circuit that drives the display panel, and a backlight unit that provides the display panel with light. Liquid crystal molecules of the liquid crystal layer are rearranged in response to a driving signal applied to the display panel, and a transmittance of the light passing through the liquid crystal layer is controlled by the arrangement of the liquid crystal molecules, thereby displaying a desired image.

The backlight unit includes a plurality of light sources to emit light and a light source driver to drive the light sources. The light sources may include fluorescent lamps or light emitting diodes, for example. The light source driver may repeatedly turn on and off the light sources using a pulse width modulation signal to drive the light sources. Accordingly, power consumption in the backlight unit may increase due to frequency components of the pulse width modulation signal. In addition, since the output of the light source driver, which is connected to the light source, is repeatedly turned on and off by the pulse width modulation signal, an audible noise may occur.

SUMMARY

Exemplary embodiments relate to a backlight unit, in which occurrence of an audible noise is effectively prevented and power consumption is substantially reduced.

Exemplary embodiments relate to a display apparatus including the backlight unit.

In an exemplary embodiment, a backlight unit includes a plurality of light source units which emits light and a plurality of light source driving integrated circuits ("IC"s) which controls a brightness of the light source units, respectively. In such an embodiment, each of the light source driving ICs includes a current generator which generates a first current and a second current, a current level controller which controls a current value of the first current in response to duty ratio information of a pulse width modulation signal, a voltage supply unit which outputs a voltage corresponding to the second current, an output buffer unit which outputs the voltage provided from the voltage supply unit, and a driving switch unit which drives the light source units to allow a current corresponding to the voltage provided from the output buffer unit to flow through the light source units. In such an embodiment, the second current has a current value substantially the same as the current value of the first current.

In an exemplary embodiment, the backlight unit may further include a controller which generates the pulse width modulation signal by controlling a duty ratio of a reference pulse width modulation signal and provides the duty ratio information of the pulse width modulation signal to the current level controller.

In an exemplary embodiment, the duty ratio information of the pulse width modulation signal may be a digital control signal based on an inter-integrated circuit ("I2C") interface.

In an exemplary embodiment, the current generator may include a current mirror unit which includes a current mirror and generates the first current and the second current, and a variable resistor which has a resistance controlled by the current level controller and controls the current value of the first current.

In an exemplary embodiment, the current level controller may control the resistance value of the variable resistor in response to the duty ratio information of the pulse width modulation signal, and the resistance value of the variable resistor may be substantially inversely proportional to the duty ratio of the pulse width modulation signal.

In an exemplary embodiment, a backlight unit includes a plurality of light source units which emits light, and a plurality of light source driving ICs which controls a brightness of the light source units, respectively, where the brightness of the light source units corresponds to a brightness value in a plurality of brightness levels. In such an embodiment, each of the light source driving ICs includes a current generator which generates a first current and a second current, a current level controller which controls a current value of the first current to have a first sub-current value and a second sub-current value in response to a brightness value, a resistance selector which selects one of the first sub-current value and the second sub-current value in response to a pulse width modulation signal, a voltage supply unit which outputs a voltage corresponding to the second current, an output buffer unit which outputs the voltage provided from the voltage supply unit and is maintained in a turned-on state, and a driving switch unit which drives the light source units to allow a current corresponding to the voltage provided from the output buffer unit to flow through the light source units. In such an embodiment, the second current has a current value substantially the same as the current value of the first current.

In an exemplary embodiment, the backlight unit may further include a controller which calculates the brightness value using image signals provided thereto, provides the brightness value to the current level controller, generate the pulse width modulation signal by controlling a duty ratio of a reference pulse width modulation signal provided thereto, and provides the pulse width modulation signal to the resistance selector.

In an exemplary embodiment, the current generator may include a current mirror unit which includes a current mirror and generates the first current and the second current, a first variable resistor which has a resistance controlled by the current level controller and controls the current value of the first current to be the first sub-current value, a second variable resistor which has a resistance controlled by the current level controller and controls the current value of the first current to be the second sub-current value greater than the first sub-current value, and a selection switch unit which selects one of the first variable resistor and the second variable resistor in response to the selection of the resistance selector.

In an exemplary embodiment, the selection switch unit may select the first variable resistor in response to the selection of the resistance selector during a low period of the pulse width modulation signal and selects the second variable resistor in response to the selection of the resistance selector during a high period of the pulse width modulation signal.

In an exemplary embodiment, the pulse width modulation signal may have a plurality of duty ratio levels, a number of levels in the brightness levels is greater than a number of levels in the duty ratio levels, and the brightness levels includes reference levels from a first reference brightness value to a second reference brightness value corresponding to the duty ratio levels.

In an exemplary embodiment, the current level controller may control the first variable resistor to have a first resistance value in response to the brightness value when the brightness value is within the reference levels in the brightness levels, the current level controller may control the second variable resistor to have a second resistance value less than the first resistance value, and the second reference brightness value may be greater than the first reference brightness value.

In an exemplary embodiment, the current level controller may control the first variable resistor to have a resistance value greater than the first resistance value in response to the brightness value when the brightness value is lower than the first reference brightness value.

In an exemplary embodiment, the current level controller may control the second variable resistor to have a resistance value less than the second resistance value in response to the brightness value when the brightness value is greater than the second reference brightness value.

In an exemplary embodiment, a display apparatus includes a backlight unit which generates light and a display panel which receives the light and displays an image. In such an embodiment, the backlight unit includes a plurality of light source units which emits the light, a plurality of light source driving ICs which controls a brightness of the light source units, respectively, and a controller which generates a pulse width modulation signal and output duty ratio information of the pulse width modulation signal by controlling a duty ratio of a reference pulse width modulation signal. In such an embodiment, each of the light source driving ICs includes a current generator which generates a first current and a second current, a current level controller which controls a current value of the first current in response to the duty ratio information of the pulse width modulation signal from the controller, a voltage supply unit which outputs a voltage corresponding to the second current, an output buffer unit which outputs the voltage provided from the voltage supply unit, and a driving switch unit which drives the light source units to allow a current corresponding to the voltage provided from the output buffer unit to flow through the light source units. In such an embodiment, the second current has a current value substantially the same as the current value of the first current.

According to exemplary embodiments, the backlight unit and the display apparatus control a current value of the current to drive the light source units without repeatedly turning on and off the output terminal of the light source driving ICs such that occurrence of the audible noise is effectively prevented and power consumption is substantially reduced.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
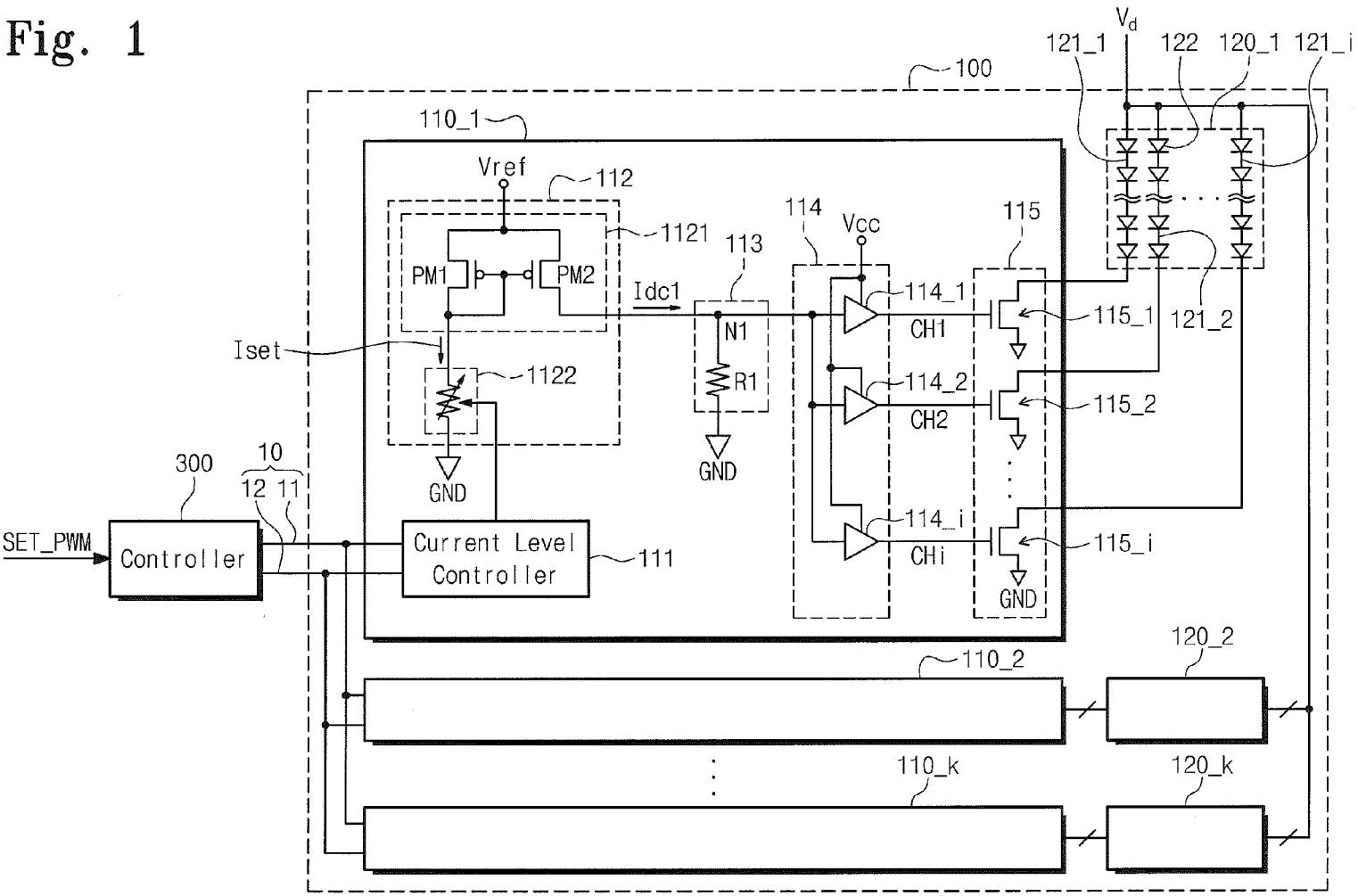
FIG. 1 is a block diagram showing an exemplary embodiment of a backlight unit according to the invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

FIG. 1 is a block diagram showing an exemplary embodiment of a backlight unit according to the invention.

Referring to FIG. 1, a backlight unit 100 includes a plurality of light source units, e.g., first to k-th light source units 120_1 to **120_*k*, and a plurality of light source driving integrated circuits ("IC"s), e.g., first to k-th light source driving ICs 110_1 to 110_*k*, corresponding to the light source units 120_1 to 120_*k***, respectively.

The light source units 120_1 to **120_*k* generate light. Each of the light source driving ICs 110_1 to 110_*k* controls brightness of a corresponding light source unit of the light source units 120_1 to 120_*k* in response to duty ratio information in a pulse width modulation signal provided from a controller 300. Hereinafter, the operation of the light source driving ICs 110_1 to 110_*k*** will be described in detail.

Each of the light source units 120_1 to **120_*k* receives a light source driving voltage Vd and includes a plurality of light source strings, e.g., first to i-th light source strings 121_1 to 121_*i*, connected to each other in parallel. Each of the light source strings 121_1 to 121_*i* includes a plurality of light emitting diodes 122 electrically connected to each other in series. In an exemplary embodiment, the number of the light emitting diodes 122 and the number of the light source strings 121_1 to 121_*i* may be determined based on a size of the display apparatus and capability of the light emitting diodes 122**.

Each of the light source driving ICs 110_1 to **110_*k* includes a current level controller 111, a current generator 112, a voltage supply unit 113, an output buffer unit 114, a driving switch unit 115 and a plurality of channels, e.g., first to i-th channels CH1 to CHi. The channels CH1 to CHi of each of the light source driving ICs 110_1 to 110_*k* are respectively connected to the light source strings 121_1 to 121_*i* of a corresponding light source unit of the light source units 120_1 to 120_*k* through the driving switch unit 115**. Here, each of i and k is a natural number.

In such an embodiment, the number of the light source strings 121_1 to **121_*i* may be determined based on the number of the channels of the light source driving ICs 110_1 to 110_*k*. In one exemplary embodiment, for example, the backlight unit 100 includes 8-channel light source driving ICs, each of the light source units 120_1 to 120_*k* may include eight light source strings. In such an embodiment, the number of the light source driving ICs 110_1 to 110_*k* increases when the number of the light source strings 121_1 to 121_*i*** is increased.

The light source driving ICs 110_1 to **110_*k* have substantially the same configuration and function as each other, and the light source units 120_1 to 120_*k* have substantially the same configuration and function as each other. Accordingly, hereinafter, the first light source driving IC 110_1 and the first light source unit 120_1** will be described in detail, and any repetitive detailed descriptions of the other light source driving ICs and the other light source unit will be omitted.

The current generator 112 of the first light source driving IC 110_1 includes a current mirror unit 1121 and a variable resistor 1122, and the voltage supply unit 113 of the first light source driving IC 110_1 includes a resistor R1 and a node N1.

The output buffer unit 114 of the first light source driving IC 110_1 includes a plurality of output buffers, e.g., first to i-th output buffers 114_1 to **114_*i*, and the driving switch unit 115 of the first light source driving IC 110_1 includes a plurality of transistors, e.g., first to i-th transistors 115_1 to 115_*i*, corresponding to the output buffers 114_1 to 114_*i***, respectively.

The current mirror unit 1121 includes a first p-channel-metal-oxide-semiconductor ("PMOS") transistor PM1 and a second PMOS transistor PM2. Each of the first and second PMOS transistors PM1 and PM2 includes a source terminal applied with a reference voltage Vref and a gate terminal connected to a drain terminal of the first PMOS transistor PM1. The drain terminal of the first PMOS transistor PM1 is connected to a first terminal of the variable resistor 1122, and a second terminal of the variable resistor 1122 is connected to a ground voltage GND.

A drain terminal of the second PMOS transistor PM2 is connected to a first terminal of the first resistor R1 of the voltage supply unit 113 and an input terminal of each of the output buffers 114_1 to **114_*i* of the output buffer unit 114. A second terminal of the first resistor R1** is connected to the ground voltage GND.

The node N1 of the voltage supply unit 113 is an electric contact, at which the drain terminal of the second PMOS transistor PM2 is in contact with the first terminal of the first resistor R1.

When the first light source driving IC 110_1 is driven, the output buffers 114_1 to **114_*i* of the output buffer unit 114** are applied with a driving voltage Vcc and maintained in a turned-on state.

An output terminal of each of the output buffers 114_1 to **114_*i* of the output buffer unit 114 is connected to a gate terminal of a corresponding transistor of the transistors 115_1 to 115_*i*. Each of the transistors 115_1 to 115_*i* includes an output terminal connected to a corresponding light source string of the light source strings 121_1 to 121_*i*. In an exemplary embodiment, each of the transistors 115_1 to 115_*i* includes a drain terminal connected to a corresponding light source string of the light source strings 121_1 to 121_*i***.

In an exemplary embodiment, the controller 300 communicates with the current level controller 111 based on an inter-integrated circuit ("I2C") interface. The backlight unit 100 may be configured to further include the controller 300. The controller 300 may be, but not limited to, a timing controller that outputs driving signals to drive the display panel.

The I2C interface is a comprehensive protocol to transmit serial data and is established as a bus using the controller 300 and an I2C bus line 10. The I2C bus line 10 includes a serial data bus line 11 (hereinafter, referred to as SDA bus line) used as a data bus line and a serial clock bus line 12 (hereinafter, referred to as SCL bus line) used as a clock bus line.

The SDA bus line 11 and the SCL bus line 12 are connected to peripheral devices or slave devices. Various desired systems may be embodied by connecting various devices, such as a memory, an analog-to-digital converter and a liquid crystal display ("LCD") driver, for example, to the SDA bus line 11 and the SCL bus line 12.

In an exemplary embodiment, the light source driving ICs 110_1 to **110_*k* are connected to the SDA bus line 11 and the SCL bus line 12**.

The controller 300 receives a reference pulse width modulation signal SET_PWM from an external device (not shown) and controls a duty ratio of the reference pulse width modulation signal SET_PWM to generate the pulse width modulation signal. The duty ratio is defined by the ratio of a high level period to a cycle or period of the pulse width modulation signal. The controller 300 provides the duty ratio information in the pulse width modulation ("PWM") signal (hereinafter, referred to as PWM duty ratio information) to the current level controller 111 of the first light source driving IC 110_1 using the I2C interface.

In an exemplary embodiment, the controller 300 selects the current level controller 111 of the first light source driving IC 110_1 as a device to receive the PWM duty ratio information and transmits a data frame about the duty ratio information, in which an identification ("ID") code of the device, e.g., the current level controller 111, is included, onto the SDA bus line 11. In such an embodiment, the controller 300 maintains the SCL bus line 12 in a high state and communicates with the current level controller 111 of the first light source driving IC 110_1 as the device responding to the ID code. That is, the controller 300 transmits the PWM duty ratio information to the current level controller 111 of the first light source driving IC 110_1. In such an embodiment, the PWM duty ratio information is a digital control signal in accordance with the I2C interface.

The current level controller 111 varies a resistance value of the variable resistor 1122 in response to the PWM duty ratio information to allow the variable resistor 1122 to have a resistance corresponding to the duty ratio of the pulse width modulation signal.

In one exemplary embodiment, for example, the resistance value of the variable resistor 1122 may be substantially inversely proportional to the duty ratio of the pulse width modulation signal. In such an embodiment, as the duty ratio of the pulse width modulation signal increases, the resistance value of the variable resistor 1122 is decreased by the current level controller 111 that controls the resistance value of the variable resistor 1122 in response to the PWM duty ratio information. In such an embodiment, as the duty ratio of the pulse width modulation signal decreases, the resistance value of the variable resistor 1122 is increased by the current level controller 111 that controls the resistance value of the variable resistor 1122 in response to the PWM duty ratio information.

The current mirror unit 1121 of the current generator 112 receives the reference voltage Vref and generates a first current Iset and a second current Idc1. Since the current mirror unit 1121 is configured to include a current mirror, the first current Iset has substantially the same current value as the current value of the second current Idc1.

In an exemplary embodiment, when the first and second PMOS transistors PM1 and PM2 of the current mirror unit 1121 are turned on, a current flows from the source terminal to the drain terminal of each of the first and second PMOS transistors PM1 and PM2 by the reference voltage Vref. The first and second PMOS transistors PM1 and PM2 of the current mirror unit 1121 configured to include the current mirror have substantially the same size and substantially the same operating characteristics as each other. Thus, the first current Iset flowing through the first PMOS transistor PM1 has substantially the same current value as the current value of the second current Idc1 flowing through the second PMOS transistor PM2.

In an exemplary embodiment, the first current Iset flows through the variable resistor 1122, and the first current Iset may be adjusted by the resistance value of the variable resistor 1122. As the resistance value of the variable resistor 1122 increases, the current value of the first current Iset decreases, and the current value of the first current Iset increases as the resistance value of the variable resistor 1122 decreases. In such an embodiment, the current value of the first current Iset may be substantially inversely proportional to the resistance value of the variable resistor 1122.

The resistance value of the variable resistor 1122 is substantially inversely proportional to the duty ratio of the pulse width modulation signal, and the current value of the first current Iset is substantially inversely proportional to the resistance value of the variable resistor 1122. Accordingly, the current value of the first current Iset may be substantially proportional to the duty ratio of the pulse width modulation signal.

In an exemplary embodiment, the first current Iset and the second current Idc1 have substantially the same current value as each other, and thus the current value of the second current Idc1 becomes substantially equal to the current value of the first current Iset when the current value of the first current Iset is controlled by the resistance value of the variable resistor 1122. In such an embodiment, the current values of the first current Iset and the second current Idc1 are controlled by the resistance value of the variable resistor 1122, and the current values of the first current Iset and the second current Idc1 may be substantially proportional to the duty ratio of the pulse width modulation signal.

The voltage supply unit 113 applies a voltage corresponding to the current value of the second current Idc1 to the driving switch unit 115 through the output buffer unit 114. The driving switch unit 115 drives the first light source unit

120_1 to allow a current corresponding to the voltage provided through the output buffer unit 114 to flow through the first light source unit 120_1.

In an exemplary embodiment, the resistor R1 of the voltage supply unit 113 has a constant resistance. In such an embodiment, where the resistance is constant, the level of the voltage is substantially proportional to the current value. The second current Idc1 flows to the ground voltage GND through the resistor R1 of the voltage supply unit 113. Therefore, a voltage level at the node N1 (hereinafter, referred to as "node voltage") of the voltage supply unit 113 is substantially proportional to the current value of the second current Idc1.

The node voltage of the voltage supply unit 113 is applied to the output terminals of the output buffers 114_1 to **114_*i*. The output terminals of the output buffers 114_1 to 114_*i* are connected to the gate terminals of the transistors 115_1 to 115_*i*, respectively. Accordingly, the node voltage is applied to the gate terminals of the transistors 115_1 to 115_*i* of the driving switch unit 115 through the output buffers 114_1 to 114_*i***.

The transistors 115_1 to **115_*i* are turned on in response to the node voltage applied through the output buffers 114_1 to 114_*i*. A current having a current value corresponding to the level of the node voltage flows through the transistors 115_1 to 115_*i***.

In one exemplary embodiment, for example, the current value of the current flowing through the turned-on transistors 115_1 to **115_*i* is substantially proportional to the level of the node voltage. In such an embodiment, the level of the node voltage is substantially proportional to the current value of the second current Idc1. Thus, as the current value of the second current Idc1 increases, the level of the node voltage increases, and the current value of the current flowing through the transistors 115_1 to 115_*i* is thereby increased. In such an embodiment, as the current value of the second current Idc1 decreases, the level of the node voltage decreases, and the current value of the current flowing through the transistors 115_1 to 115_*i*** is thereby decreased.

Since the level of the node voltage is substantially proportional to the current value of the second current Idc1, the level of the node voltage is substantially proportional to the duty ratio of the pulse width modulation signal. Thus, the current having the current value substantially proportional to the duty ratio of the pulse width modulation signal flows through the turned-on transistors 115_1 to **115_*i***.

The level of the node voltage is set to have a level greater than or equal to a minimum level to turn on the transistors 115_1 to **115_*i*. The level of the node voltage is substantially proportional to the current value of the second current Idc1, and the current value of the second current Idc1 is substantially inversely proportional to the resistance value of the variable resistor 1122. Accordingly, the maximum of the resistance value of the variable resistor 1122 may be controlled to allow the maximum resistance value of the variable resistor 1122 to be greater than the minimum level of the node voltage to turn on the transistors 115_1 to 115_*i***.

The drain terminal of each of the transistors 115_1 to **115_*i* is connected to the corresponding light source string of the light source strings 121_1 to 121_*i*. Therefore, the light source unit 120_1 emits the light in brightness substantially proportional to the current flowing through the turned-on transistors 115_1 to 115_*i*. That is, the light source unit 120_1 may have the brightness corresponding to the duty ratio of the pulse width modulation signal. Since the brightness of the light source unit 120_1 is substantially proportional to the duty ratio of the pulse width modulation signal, the brightness of the light source unit 120_1** may become higher as the duty ratio of the pulse width modulation signal increases.

The output buffer unit 114 is maintained in the turned-on state by the driving voltage Vcc. The driving switch unit 115 is maintained in the turned-on state by the node voltage Vn1 applied through the output buffer unit 114, and the current corresponding to the level of the node voltage Vn1 flows through the transistors 115_1 to **115_*i* of the driving switch unit 115. The output buffer unit 114 and the driving switch unit 115 may be defined as the output terminal of the first light source driving IC 110_1**.

In an exemplary embodiment, the output terminal of the first light source driving IC 110_1 is maintained in the turned-on state without being repeatedly turned on and off, and the first light source driving IC 110_1 controls the current value of the current to control the brightness of the light source unit 120_1.

In such an embodiment, the backlight unit 100 controls an amount of the current to drive the light source units 120_1 to **120_*k* without repeatedly turning on and off the light source driving ICs 110_1 to 110_*k*** such that occurrence of the audible noise is effectively prevented and the power consumption is substantially reduced.

Figure 2:
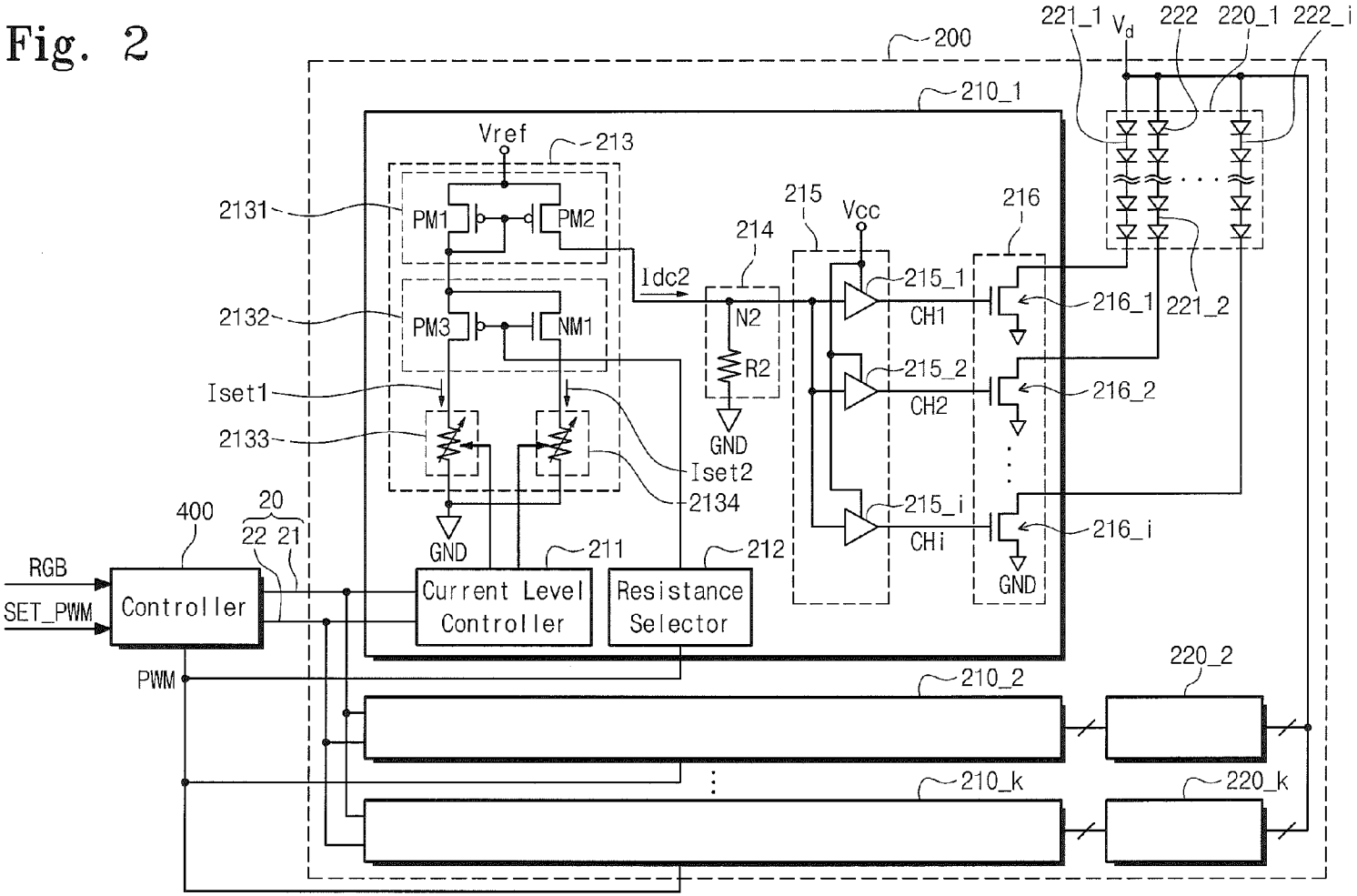
FIG. 2 is a block diagram showing an alternative exemplary embodiment of a backlight unit according to the invention.
Figure 3:
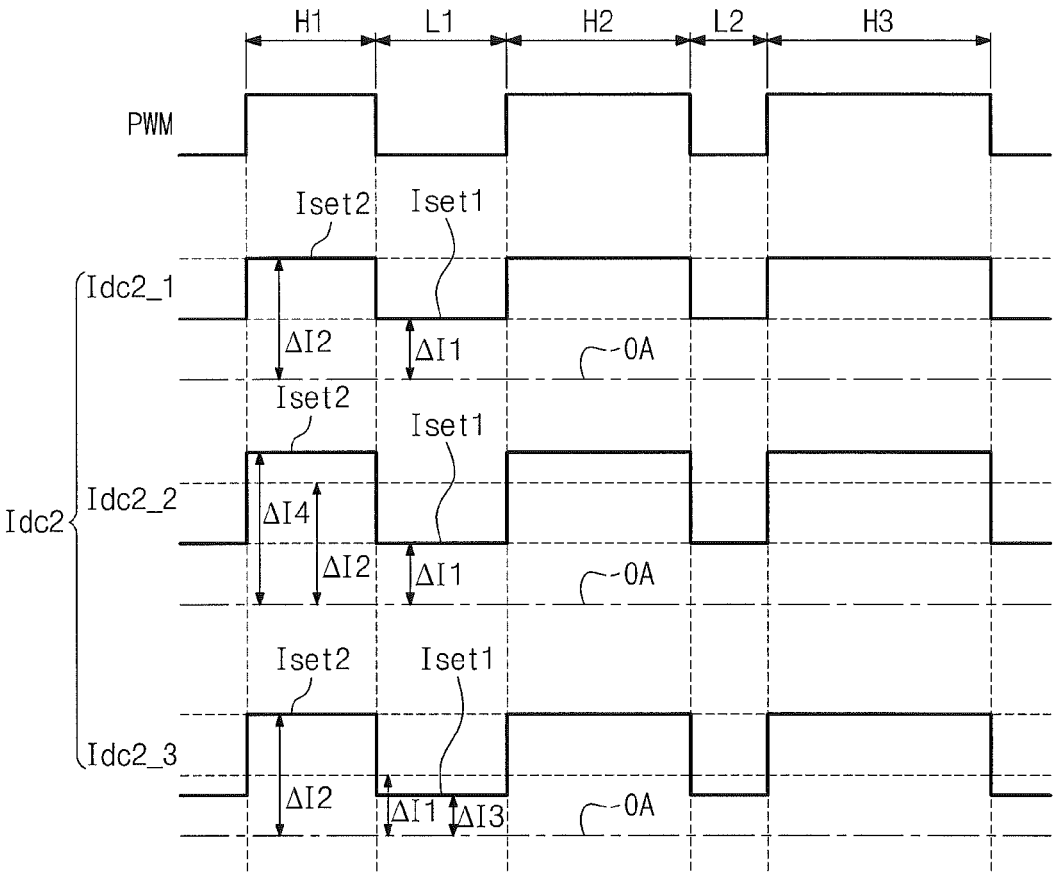
FIG. 3 is a signal timing diagram showing a variation of a second current when the backlight unit shown in FIG. 2 is driven.

FIG. 2 is a block diagram showing an alternative exemplary embodiment of a backlight unit according to the invention, and FIG. 3 is a signal timing diagram showing a variation of a second current when the backlight unit shown in FIG. 2 is driven.

Referring to FIG. 2, a backlight unit 200 includes a plurality of light source units, e.g., first to k-th light source units 220_1 to **220_*k*, and a plurality of light source driving ICs, e.g., first to k-th light source driving ICs 210_1 to 210_*k*, corresponding to the light source units 220_1 to 220_*k***, respectively.

Each of the light source driving ICs 210_1 to **210_*k* controls the brightness of a corresponding light source unit of the light source units 220_1 to 220_*k* in response to a brightness value and a pulse width modulation signal provided from a controller 400. Hereinafter, the operation of the light source driving ICs 210_1 to 210_*k*** will be described in detail.

The light source units 220_1 to **220_*k* have substantially the same configuration as the light source units 120_1 to 120_*k* shown in FIG. 1 except that the light source units 220_1 to 220_*k* are assigned with different reference numerals from those of the light source units 120_1 to 120_*k* shown in FIG. 1. Accordingly, any repetitive detailed description of the configuration of the light source units 220_1 to 220_*k*** will be hereinafter omitted.

The light source driving ICs 210_1 to **210_*k* have substantially the same configuration and function as each other, and the light source units 220_1 to 220_*k* have substantially the same configuration and function as each other, and thus, hereinafter, one light source driving IC, e.g., the first light source driving IC 210_1, and one light source unit, e.g., the first light source unit 220_1**, will be described in detail, and any repetitive detailed description of the other light source driving ICs and the other light source units will be omitted.

Each of the light source driving ICs 210_1 to **210_*k* includes a current level controller 211, a resistance selector 212, a current generator 213, a voltage supply unit 214, an output buffer unit 215, a driving switch unit 216 including a plurality of transistors, e.g., first to i-th transistors 216_1 to 216_*i*, and a plurality of channels, e.g., first to i-th channels CH1** to CHi.

The current generator 213 of the first light source driving IC 210_1 includes a current mirror unit 2131, a selection switch unit 2132, a first variable resistor 2133 and a second variable resistor 2134.

The current mirror unit 2131 includes a first PMOS transistor PM1 and a second PMOS transistor PM2. The selection switch unit 2132 includes a third PMOS transistor PM3 and a NMOS transistor NM1.

Each of the first and second PMOS transistors PM1 and PM2 includes a source terminal applied with a reference voltage Vref and a gate terminal connected to a drain terminal of the first PMOS transistor PM1. The drain terminal of the first PMOS transistor PM1 is connected to a source terminal of each of the third PMOS transistor PM3 and the NMOS transistor NM1.

A drain terminal of the second PMOS transistor PM2 is connected to a first terminal of the resistor R2 of the voltage supply unit 214. A second terminal of the resistor R2 of the voltage supply unit 214 is connected to the ground voltage GND.

The gate terminal of each of the third PMOS transistor PM3 and the NMOS transistor NM1 is connected to the resistance selector 212 to receive a selection control signal.

A drain terminal of the third PMOS transistor PM3 is connected to a first terminal of the first variable resistor 2133 and a drain terminal of the NMOS transistor NM1 is connected to the second variable resistor 2134.

A second terminal of each of the first variable resistor 2133 and the second variable resistor 2134 is connected to the ground voltage GND. A node N2 of the voltage supply unit 214 is an electric contact, at which the drain terminal of the second PMOS transistor PM2 is in contact with the first terminal of the second resistor R2.

In an exemplary embodiment, the voltage supply unit 214, the output buffer unit 215, and the driving switch unit 216 have substantially the same configuration as the configurations of the voltage supply unit 113, the output buffer unit 114 and the driving switch unit 115, shown in FIG. 1 except that the voltage supply unit 214, the output buffer unit 215, and the driving switch unit 216 are assigned with different reference numerals from those of the voltage supply unit 113, the output buffer unit 114 and the driving switch unit 115 shown in FIG. 1. Accordingly, any repetitive detailed descriptions of the voltage supply unit 214, the output buffer unit 215 and the driving switch unit 216 will hereinafter be omitted.

The controller 400 communicates with the current level controller 211 using I2C interface. In an exemplary embodiment, the backlight unit 200 may be configured to include the controller 400. In such an embodiment, the controller 400 may be, but not limited to, a timing controller that outputs driving signals to drive the display panel. Any repetitive detailed description of the I2C interface, described above with reference to FIG. 1, will be omitted.

The SDA bus line 21 and the SCL bus line 22 are connected to the light source driving ICs 210_1 to **210_*k***.

The controller 400 receives image signals RGB and a reference pulse width modulation signal SET_PWM from an external device (not shown). The controller 400 calculates a brightness value using the image signals RGB and provides the brightness value to the current level controller 211 through the I2C bus line 20.

The current level controller 211 controls the first and second variable resistors 2133 and 2134 to have first and second resistance values, respectively, in response to the brightness value. In an exemplary embodiment, the first resistance value is greater than the second resistance value, but it should not be limited thereto. In an exemplary embodiment, the first variable resistor 2133 may have a resistance value greater than the first resistance by the current level controller 211. In such an embodiment, the second variable resistor 2134 may have a resistance value less than the second resistance value by the current level controller 211. The operation of the backlight unit 200 based on the resistance value will be described later in greater detail.

The controller 400 controls the duty ratio of the reference pulse width modulation signal SET_PWM and generates a pulse width modulation signal PWM. In an exemplary embodiment, for example, the duty ratio of the reference pulse width modulation signal SET_PWM is 100%, and the duty ratio of the pulse width modulation signal PWM may be controlled to have a value in 256 levels, e.g., from zero (0) to 255, corresponding to a range of zero (0) to 100%. In an alternative exemplary embodiment, the duty ratio of the reference pulse width modulation signal SET_PWM is 50%, and the duty ratio of the pulse width modulation signal PWM may be controlled to have a value in 128 levels, e.g., from zero (0) to 127, corresponding to a range of zero (0) to 50%. The controller 400 applies the pulse width modulation signal PWM to the resistance selector 212.

The resistance selector 212 generates a selection control signal in response to the pulse width modulation signal PWM. The resistance selector 212 applies the selection control signal to the gate terminal of each of the third PMOS transistor PM3 and the NMOS transistor NM1 of the selection switch unit 2132.

The third PMOS transistor PM3 and the NMOS transistor NM1 of the selection switch unit 2132 are turned on or off by the selection control signal applied from the resistance selector 212.

In an exemplary embodiment, the resistance selector 212 generates the selection control signal to turn on the NMOS transistor NM1 in response to a high period of the pulse width modulation signal PWM. In such an embodiment, the resistance selector 212 generates the selection control signal to turn on the third PMOS transistor PM3 in response to a low period of the pulse width modulation signal PWM. Thus, the resistance selector 212 turns on the NMOS transistor NM1 during the high period of the pulse width modulation signal PWM, and the resistance selector 212 turns on the third PMOS transistor PM3 during the low period of the pulse width modulation signal PWM.

The current mirror unit 2131 has substantially the same configuration as the current mirror unit 1121 shown in FIG. 1. In an exemplary embodiment, the current mirror unit 2131 receives the reference voltage Vref and generates a first current and a second current Idc2 having the same current value as each other.

The first current includes a first sub-current Iset1 having a current value controlled by the first variable resistor 2133 and a second sub-current Iset2 having a current value controlled by the second variable resistor 2134.

When the third PMOS transistor PM3 of the selection switch unit 2132 is turned on by the resistance selector 212, the first sub-current Iset1 flows through the third PMOS transistor PM3. Accordingly, the current value of the first sub-current Iset1 generated by the current mirror unit 2131 is controlled by the first variable resistor 2133, and the current value of the second current Idc2 is controlled to be substantially equal to the current value of the first sub-current Iset1.

When the NMOS transistor NM1 of the selection switch unit 2132 is turned on by the resistance selector 212, the second sub-current Iset2 flows through the NMOS transistor NM1. Accordingly, the current value of the second sub-current Iset2 generated by the current mirror unit 2131 is controlled by the second variable resistor 2134, and the current value of the second current Idc2 is controlled to be equal to the current value of the second sub-current Iset2.

In such an embodiment, the first resistance of the first variable resistor 2133 is greater than the second resistance value of the second variable resistor 2134, and the current value of the first sub-current Iset1 is thereby less than the current value of the second sub-current Iset2.

In an exemplary embodiment, during the low period of the pulse width modulation signal PWM, the current mirror unit 2131 generates the second current Idc2 having the same current value as the first sub-current Iset1 corresponding to the first resistance value. In an exemplary embodiment, during the high period of the pulse width modulation signal PWM, the current mirror unit 2131 generates the second current Idc2 having the same current value as the second sub-current Iset2 corresponding to the second resistance value.

The voltage supply unit 214 applies the voltage at the node N2 thereof, which corresponds to the second current Idc2, to the driving switch unit 216 through the output buffer unit 215. The voltage supply unit 214 has substantially the same configuration as the voltage supply unit 113 shown in FIG. 1, and the voltage at the node N2 thereof is also referred to as a node voltage.

In an exemplary embodiment, during the low period of the pulse width modulation signal PWM, the node voltage corresponding to the second current Idc2 having substantially the same current value as the first sub-current Iset1 is applied to the driving switch unit 216. During the high period of the pulse width modulation signal PWM, the node voltage corresponding to the second current Idc2 having substantially the same current value as the second sub-current Iset2 is applied to the driving switch unit 216.

In such an embodiment, a current corresponding to the node voltage flows through the first light source unit 220_1 by the driving switch unit 216. The operation of the output buffer unit 215, the driving switch unit 216 and the first light source unit 220_1 has been described with reference to FIG. 1, and thus any repetitive detailed description thereof will be omitted.

The brightness of the first light source unit 220_1 is substantially proportional to the duty ratio of the pulse width modulating signal. In one exemplary embodiment, for example, where the duty ratio of the pulse width modulation signal PWM is controlled to have a value in 256 levels, e.g., from 0 to 255, the first light source unit 220_1 may have the brightness corresponding to the 256 levels, e.g., from 0 to 255. As the level of the value of the duty ratio of the pulse width modulation signal PWM increases, the brightness of the first light source unit 220_1 becomes higher.

FIG. 3 shows the second current Idc2 in three states. In FIG. 3, a second current Idc2_1 when the first variable resistor 2133 has the first resistance value and the second resistance value, a second current Idc2_2 when the second variable resistor 2134 has a resistance value less than the second resistance value, and a second current Idc2_3 when the first variable resistor 2133 has a resistance value greater than the first resistance value are shown in FIG. 3.

Referring to FIG. 3, the second current Idc2_1 is determined based on the first resistance of the first variable resistor 2133 and the second resistance of the second variable resistor 2134. Accordingly, the second current Idc2_1 has substantially the same current value as the second sub-current Iset2 during the high period of the pulse width modulation signal PWM and has substantially the same current value as the first sub-current Iset1 during the low period of the pulse width modulation signal PWM.

As shown in FIG. 3, high periods H1, H2 and H3 of the pulse width modulation signal PWM have different time periods from each other. As the high period of the pulse width modulation signal PWM increases, the brightness of the light emitted from the first light source unit 220_1 increases. That is, the brightness of the first light source unit 220_1 is substantially proportional to the duty ratio of the pulse width modulation signal.

In FIG. 3, the three different high periods H1, H2 and H3 have been shown in FIG. 3, but the duty ratio of the pulse width modulation signal PWM may be controlled to have a value in various numbers of levels. When the duty ratio of the pulse width modulation signal PWM is controlled to have a value in 256 levels, e.g., from 0 to 255, the first light source unit 220_1 may represent the brightness in 256 levels while the resistance value of the first variable resistor 2133 and the resistance value of the second variable resistor 2134 are maintained at the first resistance value and the second resistance value, respectively.

In an exemplary embodiment, when the resistance value of the first variable resistor 2133 is set greater than the first resistance value, or the resistance value of the second variable resistor 2134 is set less than the second resistance value, the first light source unit 220_1 may represent the brightness in a number of levels greater than 256 levels.

In one exemplary embodiment, for example, the first light source unit 220_1 may represent the brightness in 512 levels. In such an embodiment, when the brightness lower than a first reference brightness is represented among the brightness in 512 levels, the resistance value of the first variable resistor 2133 may be set to be greater than the first resistance value. In such an embodiment, when the brightness higher than a second reference brightness is represented among the brightness in 512 levels, the resistance value of the second variable resistor 2134 may be set to be less than the second resistance value. The second reference brightness is higher than the first reference brightness, and the brightness between the first reference brightness and the second reference brightness may be represented by the duty ratios different from each other of the pulse width modulation signal PWM while the resistance value of the first variable resistor 2133 and the resistance value of the second variable resistor 2134 are maintained at the first resistance value and the second resistance value, respectively.

In one exemplary embodiment, for example, when the first reference brightness corresponds to a level of 129 and the second reference brightness corresponds to a level of 384 among the brightness in 512 levels, the brightness between the level of 129 and the level of 384 (also referred to as "reference levels") may be represented by the different duty ratios from each other of the pulse width modulation signal PWM while the resistance value of the first variable resistor 2133 and the resistance value of the second variable resistor 2134 are maintained at the first resistance value and the second resistance value, respectively. In such an embodiment, the current level controller 211 controls the resistance value of the first variable resistor 2133 to be the first resistance value and the resistance value of the second variable resistor 2134 to be the second resistance value in response to the brightness value in a range from 129 to 384 provided from the controller 400.

When the brightness higher than the brightness at the level of 384 is represented, the current level controller 211 controls the resistance value of the second variable resistor 2134 to be a fourth resistance value, which is less than the second resistance value, in response to the brightness value provided from the controller 400. The brightness value provided from the controller 400 may be a brightness value corresponding to a value within a range from 385 to 512. The resistance value of the first variable resistor 2133 may be maintained at the first resistance value.

As shown in FIG. 3, the second current Idc2_2 is determined based on the first resistance value of the first variable resistor 2133 and the fourth resistance value of the second variable resistor 2134. Since the fourth resistance value is less than the second resistance value, the second current Idc2 has a current value ΔI4 during the high period of the pulse width modulation signal PWM, which is substantially equal to a current value of the second sub-current Iset2, which is greater than a current value ΔI2 of the second sub-current Iset2 corresponding to the second resistance value. Thus, the brightness higher than the brightness in a level of 384 may be represented. The current value of the second current Idc2_2 shown in FIG. 3 is increased by substantially the same levels in each of the high periods H1, H2 and H3 of the pulse width modulation signal PWM, but it should not be limited thereto or thereby. In an exemplary embodiment, the current value of the second current Idc2_2 may be selectively increased in accordance with the value of the brightness in each of the high periods H1, H2 and H3 of the pulse width modulation signal PWM.

When the brightness lower than the brightness of the level of 129 is represented, the current level controller 211 controls the resistance value of the first variable resistor 2133 to be a third resistance value, which is greater than the first resistance value, in response to the brightness value provided from the controller 400. The brightness value provided from the controller 400 may be a value within a range from 1 to 128, that is, a natural number in a range from 1 to 128. The resistance value of the second variable resistor 2133 may be maintained at the second resistance value.

As shown in FIG. 3, the second current Idc2_3 is determined based on the third resistance value of the first variable resistor 2133 and the second resistance value of the second variable resistor 2134. Since the third resistance value is larger than the first resistance value, the second current Idc2_2 has a current value ΔI3 during the low period of the pulse width modulation signal PWM, which is substantially equal to a current value of the first sub-current Iset1, which is less than a current value ΔI1 of the first sub-current Iset1 corresponding to the first resistance value. Accordingly, the brightness in a level lower than a level of 129 may be represented. The current value of the second current Idc2_3 shown in FIG. 3 is decreased by substantially the same levels in each of the low periods L1 and L2 of the pulse width modulation signal PWM, but it should not be limited thereto or thereby. In an exemplary embodiment, the current value of the second current Idc2_3 may be selectively decreased in accordance with the value of the brightness in each of the low periods L1 and L2 of the pulse width modulation signal PWM.

The operation of the backlight unit 100 has been described when the first light source unit 220_1 represents the brightness in 512 levels, but it should not be limited thereto. In an alternative exemplary embodiment, the first light source unit 220_1 may represent the brightness much higher than the level of 512. In an exemplary embodiment, the first variable resistor 2133 may be controlled to have a resistance value greater than the third resistance value, and the second variable resistor 2134 may be controlled to have a resistance value less than the fourth resistance value.

The output terminal of the first light source driving IC 210_1 of the backlight unit 200 is maintained in the turned-on state without being repeatedly turned on and off as the backlight unit 100 shown in FIG. 1. In an exemplary embodiment, the first light source driving IC 210_1 controls the current value of the current at the node N2 of the voltage supply unit 214 to control the brightness of the light source unit 220_1.

In an exemplary embodiment, the backlight unit 200 controls the current value to drive the light source units 220_1 to **220_*k* without repeatedly turning on and off the light source driving ICs 210_1 to 210_*k*** such that occurrence of the audible noise is effectively prevented and the power consumption is substantially reduced.

Figure 4:
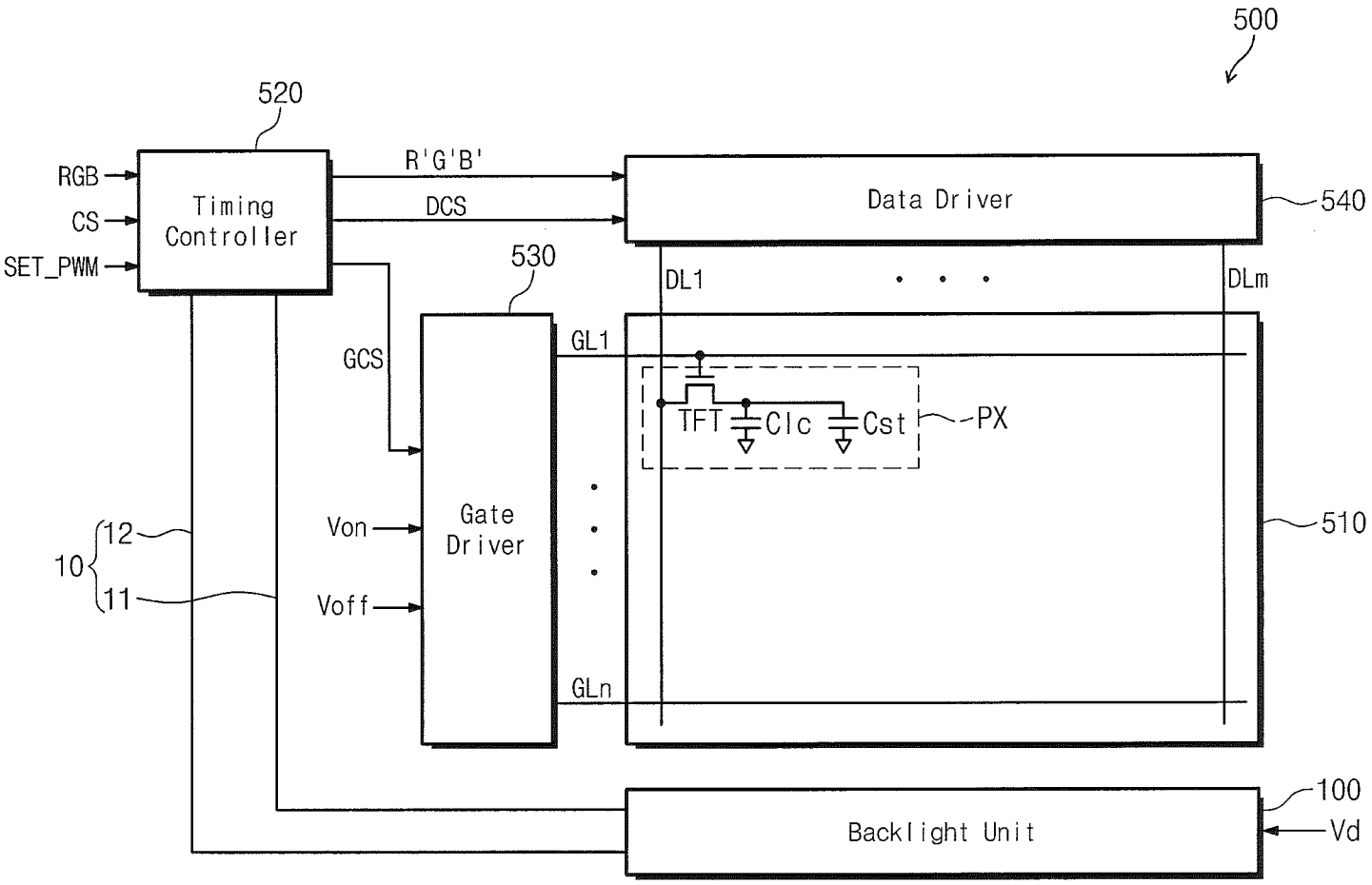
FIG. 4 is a block diagram showing an exemplary embodiment of a display apparatus according to the invention.

FIG. 4 is a block diagram showing an exemplary embodiment of a display apparatus according to the invention.

Referring to FIG. 4, a display apparatus 500 includes a liquid crystal display panel 510, a timing controller 520, a gate driver 530, a data driver 540 and a backlight unit 100.

The liquid crystal display panel 510 includes a plurality of gate lines, e.g., first to n-th gate lines GL1 to GLn, a plurality of data lines, e.g., first to m-th data lines DL1 to DLm, crossing the gate lines GL1 to GLn, and a plurality of pixels. For the convenience of description, one pixel has been shown in FIG. 4. Each of the pixels includes a thin film transistor TFT, a liquid crystal capacitor Clc and a storage capacitor Cst. The thin film transistor TFT includes a gate electrode connected to a corresponding gate line of the gate lines GL1 to GLn, a source electrode connected to a corresponding data line of the data lines DL1 to DLm, and a drain electrode connected to the liquid crystal capacitor Clc and the storage capacitor Cst.

The timing controller 520 receives an image data signal RGB, a control signal CS, and a reference pulse width modulation signal SET_PWM.

The timing controller 520 converts a data format of the image data signal RGB into a data format corresponding to an interface between the data driver 540 and the timing controller 520 and outputs the converted image data signal R'G'B' to the data driver 540.

The timing controller 520 controls the duty ratio of the reference pulse width modulating signal SET_PWM to generate the pulse width modulation signal and provides the duty ratio information of the pulse width modulation signal to the backlight unit 100 through the I2C interface. In an exemplary embodiment, the duty ratio information of the pulse width modulation signal is provided to the backlight unit 100 using the I2C bus line 10 including the SDA bus line 11 and the SCL bus line 12.

In such an embodiment, the timing controller 520 generates a data control signal DCS and a gate control signal GCS in response to the control signal CS. The timing controller 520 applies the data control signal DCS to the data driver 540 and applies the gate control signal GCS to the gate driver 530.

The gate driver 530 receives a gate-on voltage Von and a gate-off voltage Voff and sequentially outputs gate signals having the gate-on voltage Von in response to the gate control signal GCS from the timing controller 520.

The gate signals are sequentially applied to the gate lines GL1 to GLn of the liquid crystal display panel 510 to sequentially scan the gate lines GL1 to GLn.

The data driver 540 converts the image data signal R'G'B' into data signals in response to the data control signal DCS from the timing controller 520 and applies the data signals to the data lines DL1 to DLm.

When the gate signals are sequentially applied to the gate lines GL1 to GLn, the thin film transistor TFT connected to the corresponding gate line of the gate lines GL1 to GLn is turned on in response to a corresponding gate signal of the gate signals. When the data signal is applied to the data line connected to the turned-on thin film transistor TFT, the data signal is charged in the liquid crystal capacitor Clc and the storage capacitor Cst through the turned-on thin film transistor TFT.

The liquid crystal capacitor Clc controls a transmittance of the light passing through a liquid crystal layer (not shown) in accordance with the charged voltage therein. The storage capacitor Cst is charged with the data signal when the thin film transistor TFT is turned on and the storage capacitor Cst applies the charged data signal to the liquid crystal capacitor Clc when the thin film transistor TFT is turned off, thereby maintaining the charge of the liquid crystal capacitor Clc. Accordingly, the liquid crystal display panel 510 displays a gray scale corresponding to the data signal to display an image.

The backlight unit 100 provides the light to the liquid crystal display panel 210 in response to a light source driving voltage Vd. In an alternative exemplary embodiment, the display apparatus 500 may further include a voltage generator (not shown) to generate the gate-on voltage Von, the gate-off voltage Voff and the light source driving voltage Vd.

The backlight unit 100 controls the brightness of the light in response to the duty ratio information of the pulse width modulation signal provided from the timing controller 520. The backlight unit 100 shown in FIG. 4 has substantially the same configuration as the backlight unit 100 shown in FIG. 1, and detailed description of the backlight unit 100 will be omitted.

In an exemplary embodiment of the display apparatus 500, each output terminal of the light source driving ICs of the backlight unit 100 is maintained in the turned-on state without being repeatedly turned on and off. In such an embodiment, the light source driving ICs control the current value of the current to control the brightness of the light source units.

In an exemplary embodiment, the backlight unit 100 controls the current value of the current to drive the light source units without repeatedly turning on and off the light source driving ICs such that occurrence of the audible noise is effectively prevented and the power consumption is substantially reduced.

Figure 5:
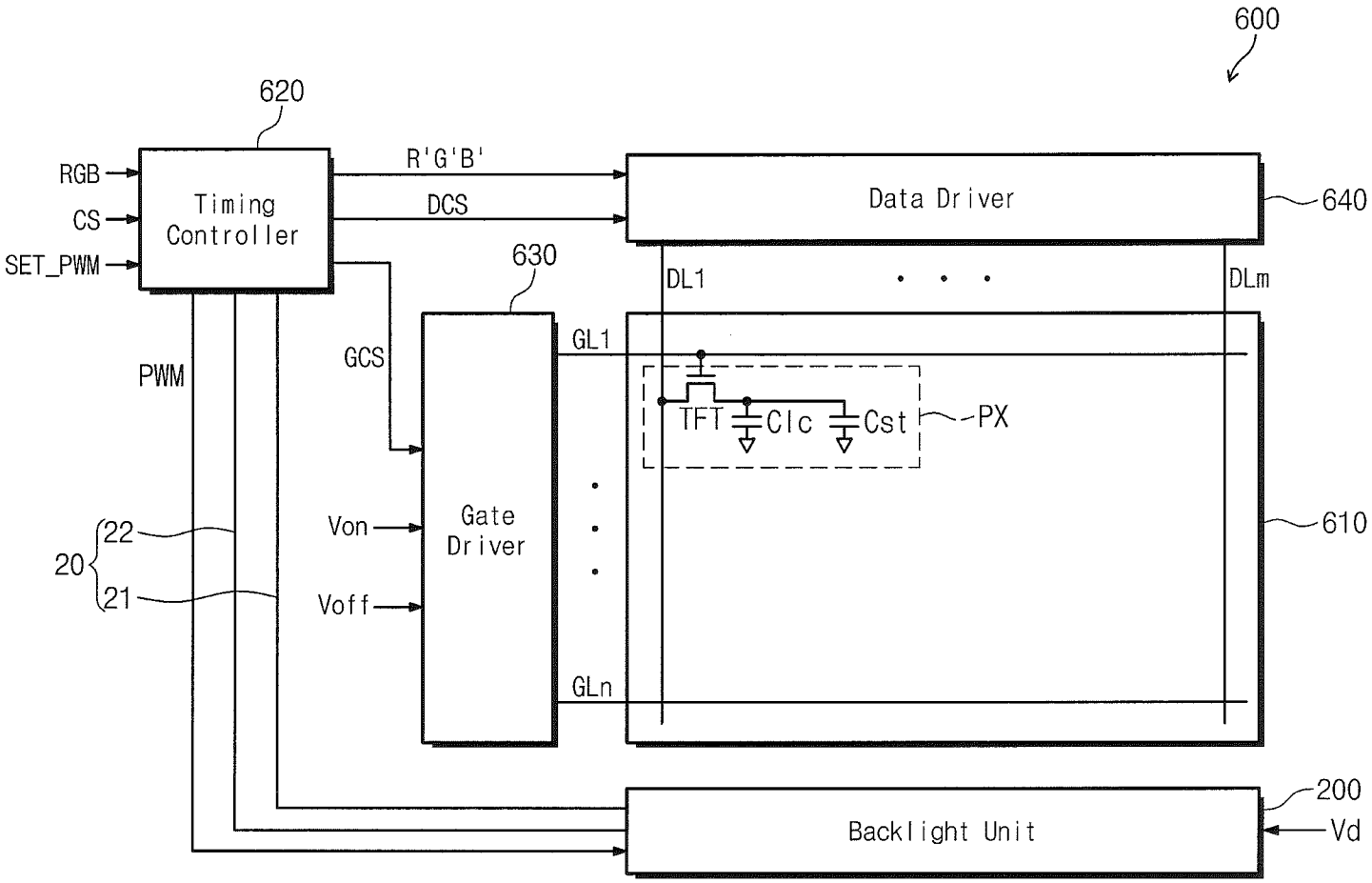
FIG. 5 is a block diagram showing an alternative exemplary embodiment of a display apparatus according to the invention.

FIG. 5 is a block diagram showing an alternative exemplary embodiment of a display apparatus according to the present invention.

Referring to FIG. 5, a display apparatus 600 includes a display panel 610, a timing controller 620, a gate driver 630, a data driver 640 and a backlight unit 200.

The timing controller 620 receives image signals RGB, control signals CS and a reference pulse width modulation signal SET_PWM. The timing controller 620 calculates a brightness value using the image signals RGB and provides the brightness value to the backlight unit 200 through the I2C bus line 20 including a SDA bus line 21 and a SCL bus line 22.

The timing controller 620 controls the duty ratio of the reference pulse width modulation signal SET_PWM to generate the pulse width modulation signal PWM and applies the pulse width modulation signal PWM to the backlight unit 200.

The timing controller 620 generates a data control signal DCS and a gate control signal GCS in response to the control signals CS. The timing controller 620 applies the data control signal DCS to the data driver 640 and applies the gate control signal GCS to the gate driver 630.

The display panel 610, the gate driver 630 and the data driver 640 of the display apparatus 600 have substantially the same configurations as those of the display apparatus 500 shown in FIG. 5, and any repetitive detailed description thereof will be omitted.

The backlight unit 200 controls the brightness of the light in response to the brightness value and the pulse width modulation signal PWM from the timing controller 620. The backlight unit 200 shown in FIG. 5 has substantially the same configuration as the backlight unit 200 shown in FIG. 2, and any repetitive detailed description of the backlight unit 200 will be omitted.

In an exemplary embodiment of the display apparatus 600, each output terminal of the light source driving ICs of the backlight unit 200 is maintained in the turned-on state without being repeatedly turned on and off. In such an embodiment, the light source driving ICs control the current value of the current to control the brightness of the light source units.

In such an embodiment, the backlight unit 200 controls the current value of the current to drive the light source units without repeatedly turning on and off the light source driving ICs such that occurrence of the audible noise is effectively prevented and the power consumption is substantially reduced.

Figure 6:
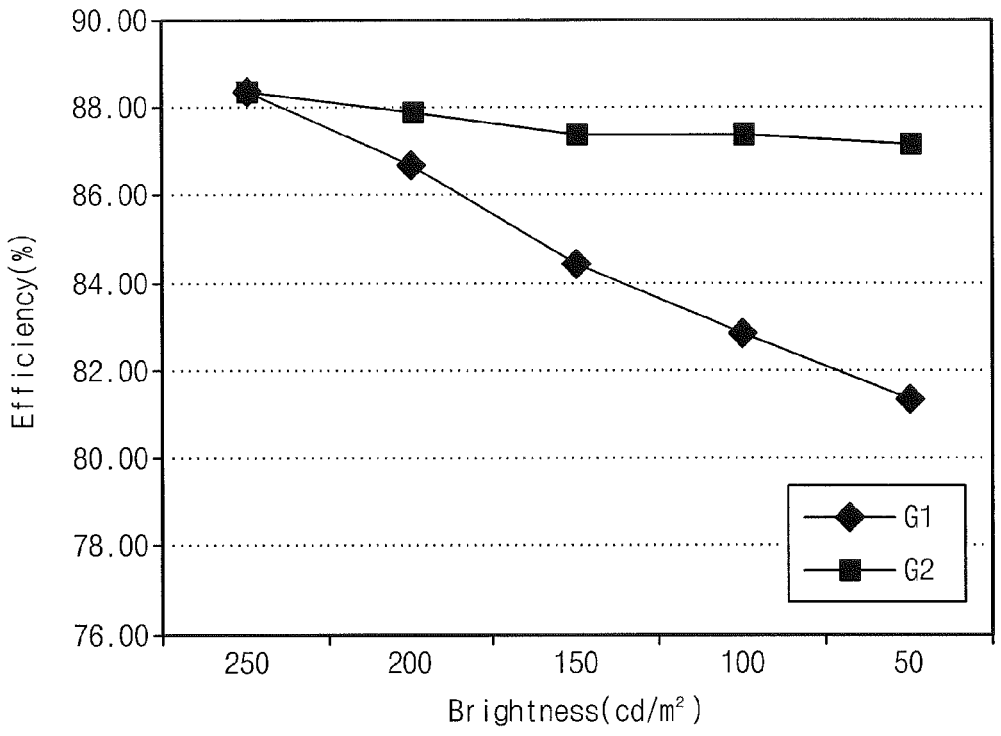
FIG. 6 is a graph showing screen display brightness efficiency (percent: %) versus luminance (candela per square meter: $cd/m^2$) of a display apparatus according to the invention.

FIG. 6 is a graph showing screen display brightness efficiency (percent: %) versus luminance (candela per square meter: $cd/m^2$) of an exemplary embodiment of a display apparatus according to the invention.

Referring to FIG. 6, when the duty ratio of the pulse width modulation signal is 100%, e.g., full duty, screen brightness is set to be about 250 $cd/m^2$. FIG. 6 shows the screen brightness measured by gradually decreasing the duty ratio of the pulse width modulation signal. In FIG. 6, brightness efficiency is obtained by measuring a brightness ratio of an ideal brightness and a real brightness.

An output terminal of a PWM driving IC using the pulse width modulation signal is maintained in the turned-on state when the duty ratio of the pulse width modulation signal is 100%. However, when the duty ratio of the pulse width modulation signal becomes smaller than 100%, the output terminal of the PWM driving IC is repeatedly turned on and off. Accordingly, each output terminal of an exemplary embodiment of the light source driving ICs according to the invention is maintained in the turned-on state without being repeatedly turned on and off. In such an embodiment, the light source driving ICs control the current value of the current to control the brightness of the light source units. Accordingly, the occurrence of the audible noise is effectively prevented and the power consumption is substantially reduced. As shown in FIG. 6, an exemplary embodiment of the display apparatus according to the invention may have the brightness efficiency (G2) higher than the brightness efficiency (G1) when the PWM driving ICs are used.

Since the output terminal of the PWM driving ICs is repeatedly turned on and off, a current having a predetermined current value is measured at the high level of the pulse width modulation signal, and a current having substantially zero (0) ampere (A) is measured at the low level of the pulse width modulation signal when the current of the output terminal of the PWM driving ICs is measured.

In an exemplary embodiment, the output terminal of the light source driving ICs is maintained in the turned-on state without being repeatedly turned on and off, and only the current value is controlled. Accordingly, the currents having different current values from each other may be measured when the current of the output terminal of the light source driving ICs.

In an exemplary embodiment, the display apparatus including the light source driving ICs may measure the current value of the current flowing through the output terminal of the driver that drives the light source unit.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A backlight unit comprising:

a plurality of light source units which emits light; and a plurality of light source driving integrated circuits which controls a brightness of the light source units, respectively, wherein each of the light source driving integrated circuits comprises:

a current generator which generates a first current and a second current;

a current level controller which controls a current value of the first current in response to duty ratio information of a pulse width modulation signal;

a voltage supply unit which outputs a voltage corresponding to the second current;

an output buffer unit which outputs the voltage provided from the voltage supply unit and maintained in a turned-on state without being repeatedly turned on and off; and a driving switch unit which drives the light source units to allow a current corresponding to the voltage provided from the output buffer unit to flow through the light source units, and wherein the second current has a current value substantially the same as the current value of the first current, wherein the current generator comprises:

a current mirror unit which includes a current mirror and generates the first current and the second current; and a variable resistor which has a resistance value controlled by the current level controller and controls the current value of the first current, and wherein the current level controller controls the resistance value of the variable resistor in response to the duty ratio information of the pulse width modulation signal, and the resistance value of the variable resistor is substantially inversely proportional to the duty ratio of the pulse width modulation signal.

2. The backlight unit of claim 1, further comprising:

a controller which controls a duty ratio of a reference pulse width modulation signal to generate the pulse width modulation signal and provide the duty ratio information of the pulse width modulation signal to the current level controller.

3. The backlight unit of claim 2, wherein the duty ratio information of the pulse width modulation signal is a digital control signal based on an inter-integrated circuit interface.

4. The backlight unit of claim 1, wherein the current value of the first current is substantially inversely proportional to the resistance value of the variable resistor and substantially proportional to the duty ratio of the pulse width modulation signal, the voltage provided from the voltage supply unit has a level substantially proportional to the current value of the second current, and the current value of the current flowing through the light source unit by the driving switch unit is substantially proportional to the level of the voltage provided from the voltage supply unit.

5. The backlight unit of claim 1, wherein each of the light source units comprises a plurality of light source strings connected to each other in parallel, wherein the light source strings receives a light source driving voltage, and each of the light source strings comprises a plurality of light emitting diodes connected to each other in series.

6. The backlight unit of claim 5, wherein the output buffer unit comprises a plurality of output buffers which outputs the voltage provided from the voltage supply unit, and the output buffers are maintained in a turned-on state.

7. The backlight unit of claim 6, wherein the driving switch unit comprises a plurality of transistors, wherein the transistors correspond to the light source strings, respectively, and correspond to the output buffers, respectively, and each of the transistors comprises:

a gate terminal which receives the voltage provided from the voltage supply unit through a corresponding output buffer of the output buffers;

a source terminal connected to a corresponding light source string of the light source strings; and a drain terminal connected to a ground voltage.

8. The backlight unit of claim 7, wherein each of the transistors is turned on in response to the voltage provided from the voltage supply unit through the corresponding output buffer, and a current having a current value corresponding to the level of the voltage provided from the voltage supply unit flows to each of the light source strings through a corresponding transistor, which is turned on.

9. A display apparatus comprising:

a backlight unit which generates light; and a display panel which receives the light and displays an image, wherein the backlight unit comprises:

a plurality of light source units which emits the light;

a plurality of light source driving integrated circuits which controls a brightness of the light source units, respectively; and a controller which generates a pulse width modulation signal by controlling a duty ratio of a reference pulse width modulation signal and outputs duty ratio information of the pulse width modulation signal, wherein each of the light source driving integrated circuits comprises:

a current generator which generates a first current and a second current;

a current level controller which controls a current value of the first current in response to the duty ratio information of the pulse width modulation signal from the controller;

a voltage supply unit which outputs a voltage corresponding to the second current;

an output buffer unit which outputs the voltage provided from the voltage supply unit and maintained in a turned-on state without being repeatedly turned on and off; and a driving switch unit which drives the light source units to allow a current corresponding to the voltage provided from the output buffer unit to flow through the light source units, wherein the second current has a current value substantially the same as the current value of the first current, wherein the current generator comprises:

a current mirror unit which includes a current mirror and generates the first current and the second current; and a variable resistor which has a resistance value controlled by the current level controller and controls the current value of the first current, and wherein the current level controller controls the resistance value of the variable resistor in response to the duty ratio information of the pulse width modulation signal, and the resistance value of the variable resistor is substantially inversely proportional to the duty ratio of the pulse width modulation signal.

* * * * *